US009914887B2

(12) United States Patent
Bhattacharya

(10) Patent No.: US 9,914,887 B2
(45) Date of Patent: Mar. 13, 2018

(54) TWO-STAGE HYDROCRACKING PROCESS FOR MAKING HEAVY LUBRICATING BASE OIL FROM A HEAVY COKER GAS OIL BLENDED FEEDSTOCK

(71) Applicant: Subhasis Bhattacharya, Walnut Creek, CA (US)

(72) Inventor: Subhasis Bhattacharya, Walnut Creek, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 5 days.

(21) Appl. No.: 14/483,331

(22) Filed: Sep. 11, 2014

(65) Prior Publication Data

US 2015/0068952 A1 Mar. 12, 2015

Related U.S. Application Data

(60) Provisional application No. 61/877,183, filed on Sep. 12, 2013.

(51) Int. Cl.

| | |
|---|---|
| ***C10G 65/10*** | (2006.01) |
| ***C10G 7/00*** | (2006.01) |
| ***C10G 69/06*** | (2006.01) |
| ***C10M 177/00*** | (2006.01) |
| ***C10M 101/02*** | (2006.01) |

(52) U.S. Cl.

CPC ..... *C10G 65/10* (2013.01); *C10G 7/003* (2013.01); *C10G 69/06* (2013.01); *C10M 101/02* (2013.01); *C10M 177/00* (2013.01); *C10M 2203/1006* (2013.01); *C10N 2270/00* (2013.01)

(58) Field of Classification Search

CPC ..... C10G 7/003; C10G 65/10; C10G 2400/10

See application file for complete search history.

(56) References Cited

U.S. PATENT DOCUMENTS

| | | | | |
|---|---|---|---|---|
| 3,308,055 | A * | 3/1967 | Kozlowski | C10G 47/00 208/110 |
| 3,759,822 | A * | 9/1973 | Folkins | C10B 55/00 208/131 |
| 4,720,337 | A * | 1/1988 | Graziani | C10G 65/043 208/58 |
| 5,460,713 | A * | 10/1995 | Takito | C10G 65/12 208/27 |
| 2007/0175794 | A1 | 8/2007 | Duininck et al. | |
| 2009/0050524 | A1 * | 2/2009 | Kim | C10G 65/12 208/89 |

OTHER PUBLICATIONS

PCT/US2014/055068, Notification of Transmittal of the International Search Report and the Written Opinion of the International Searching Authority, or the Declaration, dated Feb. 13, 2015, 13 pages.

* cited by examiner

*Primary Examiner* — Randy Boyer
(74) *Attorney, Agent, or Firm* — Mark L. Warzel

(57) ABSTRACT

The present invention is directed to a refining process for producing heavy lubricating base oils (LBO) from a blended hydrocarbonaceous feedstock containing a heavy coker gas oil, a visbroken gas oil, heavy cycle oil, oils from residue hydrocracking, aromatic extract or any other feedstock normally not conducive to lube oil basestock production, using a two-stage hydrocracking process.

18 Claims, 2 Drawing Sheets

TWO-STAGE HYDROCRACKING PROCESS FOR MAKING HEAVY LUBRICATING BASE OIL FROM A HEAVY COKER GAS OIL BLENDED FEEDSTOCK

FIELD OF THE INVENTION

The present invention is directed to a refining process for producing heavy lubricating base oils (LBOs) from a blended hydrocarbonaceous feedstock containing a heavy coker gas oil and/or one or more other feedstocks. These feedstocks are normally not suitable for heavy lubricating base oil production, particularly using a conventional two-stage hydrocracking process.

BACKGROUND OF THE INVENTION

Catalytic hydroprocessing refers to petroleum refining processes in which a carbonaceous feedstock is brought into contact with hydrogen and a catalyst, at a higher temperature and pressure, for the purpose of removing undesirable impurities and/or converting the feedstock to an improved product.

Hydrocracking is an important refining process used to produce valuable products such as turbine fuel, diesel fuel and lube oil fractions as well as lower boiling hydrocarbonaceous liquids such as naphtha and gasoline, by hydrocracking a hydrocarbon feedstock derived from crude oil.

FIG. 1 is a flow scheme for a typical two-stage, high conversion hydrocracking unit. This particular flow scheme is typically used for hydroprocessing conventional hydrocracker feedstocks, such as heavy gas oils. These feedstocks have high amounts of nitrogen, often between 500 and 2000 ppm and sulfur, often between 0.5 and 3.5 wt %, and a low API, typically between 15 and 20.

In the two-stage hydrocracking scheme illustrated in FIG. 1, a desalted crude oil feedstock 1 is distilled in an atmospheric crude distillation unit 2. The bottoms or residuum 3 from the atmospheric distillation process is then distilled in a vacuum distillation unit 4. Typical vacuum distillation units are operated to deliver a HVGO/residue cut-point of approximately 1,050° F. (566° C.). Higher cut-points (also referred to as deeper cuts) would be beneficial as this would yield a higher volume of HVGO for processing into valuable middle distillate product. However, running the vacuum distillation unit 4 at a higher cut-point means a more disadvantaged feedstock (higher particulates, more sulfur and nitrogen species and heavy polyaromatic hydrocarbons), requiring the downstream hydroprocessing units to run at higher severity levels (higher feed residence time or lower "liquid hour space velocity," and higher temperatures), lessening the life of the catalysts.

A HVGO cut 5 from the vacuum distillation unit 4 is hydrotreated in a conventional hydrotreating reactor 6, to saturate complex naphthenic and aromatic compounds and reduce feed contaminants such as nitrogen and sulfur which, if left untreated, would otherwise poison downstream hydrocracking catalysts.

The hydrotreated HVGO 7 is then subjected to hydrocracking conditions in a first stage hydrocracker unit 8, followed by atmospheric distillation of the hydrocracked HVGO feedstock 9 in an atmospheric fractionation column 10. In a typical two-stage hydroprocessing unit, the first stage hydrocracker unit 8 is operated at a severity sufficient to achieve a 45-50% conversion.

Light ends 11 and middle distillate products such as naphtha 12, kerosene 13 and diesel 14 are recovered from the atmospheric fractionation column 10, and the atmospheric bottoms fraction 15 is subjected to further hydrocracking conditions in a second stage hydrocracker unit 16. An FCC bleed 17 from the atmospheric bottoms fraction 15 stream is passed to a standard fluidized catalytic cracking (FCC) unit 18. FCC units convert high-boiling, high-molecular weight hydrocarbon fractions of petroleum crude oils into more valuable gasoline 19, olefinic gases used for making alkylate, and other products such as naphtha. Catalysts employed in FCC units are substantially more tolerant of feedstocks containing high amounts of nitrogen, sulfur and polynuclear aromatics (PNAs), as compared to conventional hydrocracking catalysts.

The entire second stage hydrocracker effluent 20 is recycled back to the atmospheric fractionation column 10. This configuration requires the undesirable components (N, S, PNAs) in the atmospheric bottoms fraction 15 to be recycled to extinction within the hydrocracking loop. This limits the types of feedstocks available for use in two-stage hydrocracking units.

Feedstocks most often subjected to hydrocracking are vacuum and atmospheric gas oils and heavy gas oils recovered from crude oil by distillation. A typical gas oil comprises a substantial portion of hydrocarbon components boiling above about 700° F., usually at least about 50 percent by weight boiling above 700° F. A typical vacuum gas oil normally has a boiling point range between about 600° F. and about 1050° F.

Another important refining process is the use of a coker unit to convert the residual oil from a vacuum distillation column or an atmospheric distillation column into $C_1$-$C_4$ light ends, naphtha, light and heavy gas oils, and petroleum coke. The process thermally cracks the long chain hydrocarbon molecules in the residual oil feed into shorter chain molecules leaving behind the excess carbon in the form of petroleum coke.

The residuum of a coker unit, heavy coker gas oil (HCGO), is a high boiling range, highly disadvantaged stream as it contains high amounts of polycyclic aromatics, and nitrogen and sulfur species. Refineries often struggle with finding ways to dispose of their HCGO streams. Some refineries pass HCGO stream on to a fluid catalytic cracking unit (FCC) unit where is upgraded to gasoline and olefinic products. However, if a refinery lacks an FCC unit, other ways of disposing of the HCGO stream must be employed. Accordingly, there is a continuing need for refining processes which allow refiners to process HCGO and other highly disadvantaged streams into more valuable products.

HCGO streams cannot be hydroprocessed using conventional two-stage hydrocracking units. This is because such units are closed looped units which require all of the disadvantaged components (e.g. N, S, PNAs) of the feed to be recycled within the loop to extinction. Because HCGO streams contain very high concentration of disadvantaged components, if a refiner were to introduce a HCGO stream into conventional two-stage hydrocracking units, the catalyst life would be hastened.

Further, conventional two-stage hydrocracking units typically produce middle distillate products listed in the table below.

| Conventional Two-Stage Hydrocracking Unit Products | Typical Cut Points, ° F. (° C.) For North American Market |
|---|---|
| Light Naphtha | $C_5$-180 ($C_5$-82) |
| Heavy Naphtha | 180-300 (82-149) |

-continued

| Conventional Two-Stage Hydrocracking Unit Products | Typical Cut Points, ° F. (° C.) For North American Market |
|---|---|
| Jet | 300-380 (149--193) |
| Kerosene | 380-530 (193-277) |
| Diesel | 530-700 (277-371) |

However, middle distillate products are not as profitable for refiners as lube oil products. Therefore, refineries are continuously looking for ways to retrofit existing hydroprocessing equipment to switch from manufacturing a middle distillate slate to a lubricating oil product slate.

Accordingly, there is a continuing need for refining processes which allow refiners to process HCGO and other highly disadvantaged streams, and allow for the manufacture of a higher quantities of highly profitable lubricating oil products.

SUMMARY OF THE INVENTION

The present invention is directed to a refining process for producing heavy lubricating base oils (LBOs) from a blended feed containing a heavy coker gas oil, using an improved two-stage hydrocracking process.

In the process of the present invention, the product stream of a first stage hydrocracking unit is fractionated into a fuels stream and a residuum stream. The residuum stream is further fractionated in a waxy vacuum column into a light vacuum gas oil range fraction (370-500° C.) and at least one heavy lubricating base oil fraction. The light vacuum gas oil distillation range fraction hydrocracked in a second stage hydrocracking unit, and the entire reaction product from the second stage hydrocracking unit is combined with the reaction product from the first stage hydrocracking unit.

At least one heavy lubricating base oil fraction is then further hydroprocessed to and fractionated to produce one or more finished heavy lubricating base oils.

DETAILED DESCRIPTION OF THE INVENTION

Introduction

Figure 1:
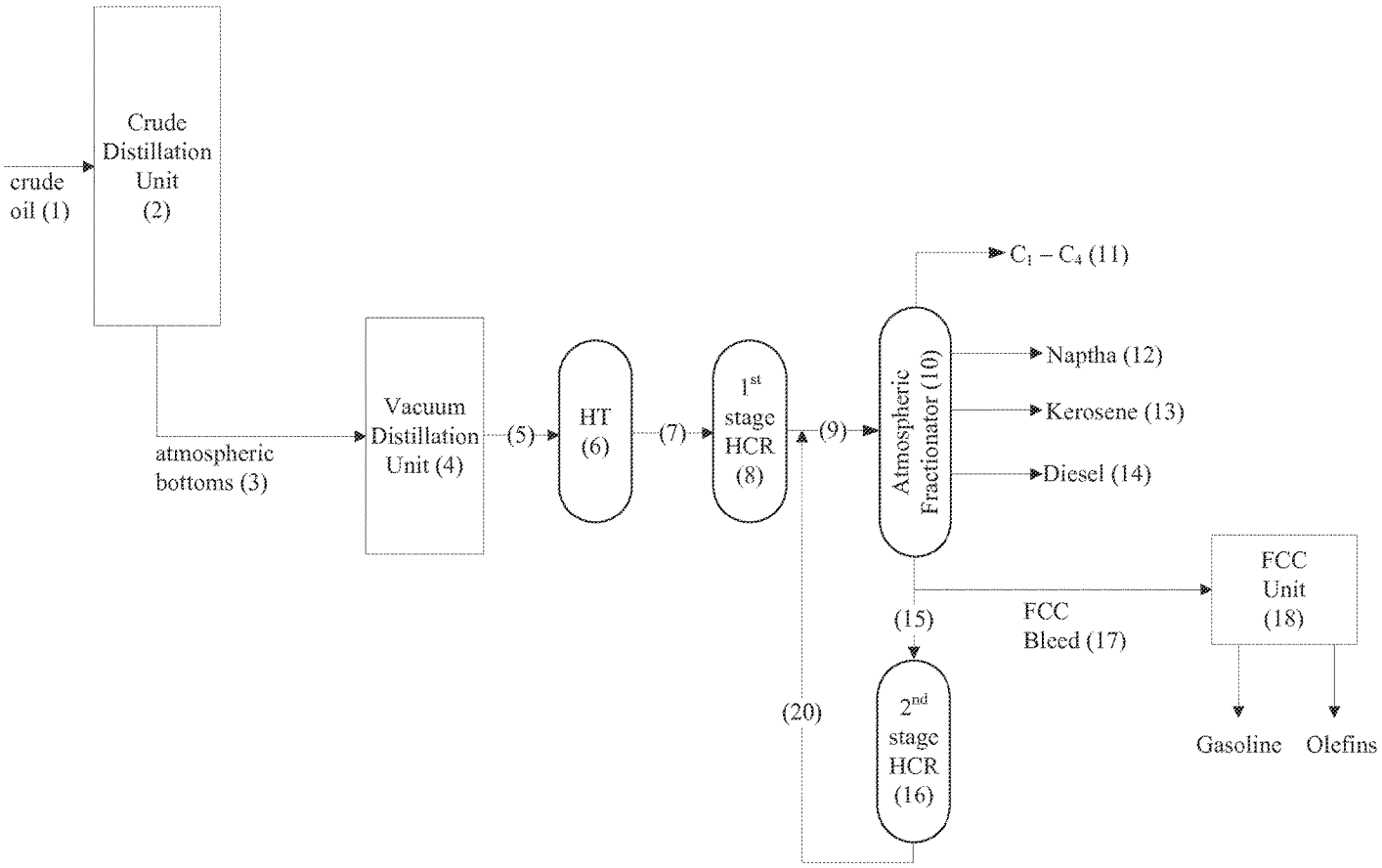
(PRIOR ART) FIG. 1
FIG. 1 is a block flow diagram of a conventional two-stage hydrocracking process.

"Periodic Table" refers to the version of IUPAC Periodic Table of the Elements dated Jun. 22, 2007, and the numbering scheme for the Periodic Table Groups is as described in Chemical and Engineering News, 63(5), 27 (1985).

"Hydroprocessing" refers to a process in which a carbonaceous feedstock is brought into contact with hydrogen and a catalyst, at a higher temperature and pressure, for the purpose of removing undesirable impurities and/or converting the feedstock to a desired product.

"Hydrotreating" refers to a process that converts sulfur- and/or nitrogen-containing hydrocarbon feeds into hydrocarbon products with reduced sulfur and/or nitrogen content, typically in conjunction with a hydrocracking function, and which generates hydrogen sulfide and/or ammonia (respectively) as byproducts.

"Hydrocracking" refers to a process in which hydrogenation and dehydrogenation accompanies the cracking/fragmentation of hydrocarbons, e.g., converting heavier hydrocarbons into lighter hydrocarbons, or converting aromatics and/or cycloparaffins (naphthenes) into non-cyclic branched paraffins "Hydroisomerization" refers to a process in which normal paraffins are isomerized to their more branched counterparts in the presence of hydrogen and over a catalyst.

"Hydrodemetalization" refers to a process that removes undesirable metals from hydrocarbon feeds and converts the latter into hydrocarbon products with reduced metal content.

"Heavy coker gas oil" refers to the bottoms fraction of a coker fractionator in a coker unit.

"Distillation column" and "fractionator" are synonymous and refer to a distillation column or columns for separating a feedstock into one or more fractions.

"Cut point" refers to the temperature on a True Boiling Point ("TBP") curve (i.e., a batch process curve of percent of feed removed in a heavily refluxed tower versus temperature reached to achieve that removal) at which a predetermined degree of separation is reached.

"True Boiling Point" (TBP) refers to the boiling point of a feed which as determined by ASTM D2887.

"Bottoms fraction" means the heavier fraction, separated by fractionation from a feedstock, as a non-vaporized (i.e. residuum) fraction.

"Hydrocracked heavy fraction" means the heavy fraction after having undergone hydrocracking.

"Hydrocarbonaceous" means a compound or substance that contains hydrogen and carbon atoms, but which can include heteroatoms such as oxygen, sulfur or nitrogen.

The term "pour point" refers to the temperature at which an oil will begin to flow under controlled conditions.

As used herein, "cloud point" refers to the temperature at which a lube oil sample begins to develop a haze as the oil is cooled under specified conditions. The cloud point of a lube base oil is complementary to its pour point.

"Middle distillates" include jet fuel, diesel fuel, naphtha and kerosene.

| Distillates | Typical Cut Points, ° F. (° C.) |
|---|---|
| Light Naphtha | $C_5$-180 ($C_5$-82) |
| Heavy Naphtha | 180-270 (82-132) |
| Kerosene | 270-550 (132-288) |
| Diesel | 550-700 (288-371) |

Where permitted, all publications, patents and patent applications cited in this application are herein incorporated by reference in their entirety; to the extent such disclosure is not inconsistent with the present invention.

Unless otherwise specified, the recitation of a genus of elements, materials or other components, from which an individual component or mixture of components can be selected, is intended to include all possible sub-generic combinations of the listed components and mixtures thereof. Also, "include" and its variants are intended to be non-limiting, such that recitation of items in a list is not to the exclusion of other like items that may also be useful in the materials, compositions and methods of this invention.

Properties for materials described herein are determined as follows:

(a) Brønsted acidity: determined by isopropylamine-temperature-programmed desorption (IPam TPD) adapted from the published descriptions by T. J. Gricus Kofke, R. K.

Gorte, W. E. Farneth, J. Catal. 114, 34-45, 1988; T. J. Gricus Kifke, R. J. Gorte, G. T. Kokotailo, J. Catal. 115, 265-272, 1989; J. G. Tittensor, R. J. Gorte and D. M. Chapman, J. Catal. 138, 714-720, 1992.

(b) $SiO_2/Al_2O_3$ Ratio (SAR): determined by ICP elemental analysis. A SAR of infinity (∞) represents the case where there is no aluminum in the zeolite, i.e., the mole ratio of silica to alumina is infinity. In that case the molecular sieve is comprised of essentially all of silica.

(c) Surface area: determined by $N_2$ adsorption at its boiling temperature. BET surface area is calculated by the 5-point method at $P/P_0$=0.050, 0.088, 0.125, 0.163, and 0.200. Samples are first pre-treated at 400° C. for 6 hours in the presence of flowing, dry $N_2$ so as to eliminate any adsorbed volatiles like water or organics.

(d) Micropore volume: determined by $N_2$ adsorption at its boiling temperature. Micropore volume is calculated by the t-plot method at $P/P_0$=0.050, 0.088, 0.125, 0.163, and 0.200. Samples are first pre-treated at 400° C. for 6 hours in the presence of flowing, dry $N_2$ so as to eliminate any adsorbed volatiles like water or organics.

(e) Mesopore pore diameter: determined by $N_2$ adsorption at its boiling temperature. Mesopore pore diameter is calculated from $N_2$ isotherms by the BJH method described in E. P. Barrett, L. G. Joyner and P. P. Halenda, "The determination of pore volume and area distributions in porous substances. I. Computations from nitrogen isotherms." J. Am. Chem. Soc. 73, 373-380, 1951. Samples are first pre-treated at 400° C. for 6 hours in the presence of flowing, dry $N_2$ so as to eliminate any adsorbed volatiles like water or organics.

(f) Total pore volume: determined by $N_2$ adsorption at its boiling temperature at $P/P_0$=0.990. Samples are first pre-treated at 400° C. for 6 hours in the presence of flowing, dry $N_2$ so as to eliminate any adsorbed volatiles like water or organics.

(g) Unit cell size: determined by X-ray powder diffraction.

(h) Alpha value: determined by an Alpha test adapted from the published descriptions of the Mobil Alpha test (P. B. Weisz and J. N. Miale, J. Catal., 4, 527-529, 1965; J. N. Miale, N. Y. Chen, and P. B. Weisz, J. Catal., 6, 278-87, 1966). The "Alpha Value" is calculated as the cracking rate of the sample in question divided by the cracking rate of a standard silica alumina sample. The resulting "Alpha" is a measure of acid cracking activity which generally correlates with number of acid sites.

(i) Target pour point: as measured by ASTM D5950.

(j) Target cloud point: as measured by ASTM D5773.

(k) Viscosity index: as measured by ASTM D445.

(l) Viscosity: as measured by ASTM D2270.

Process Overview and Conditions

Figure 2:
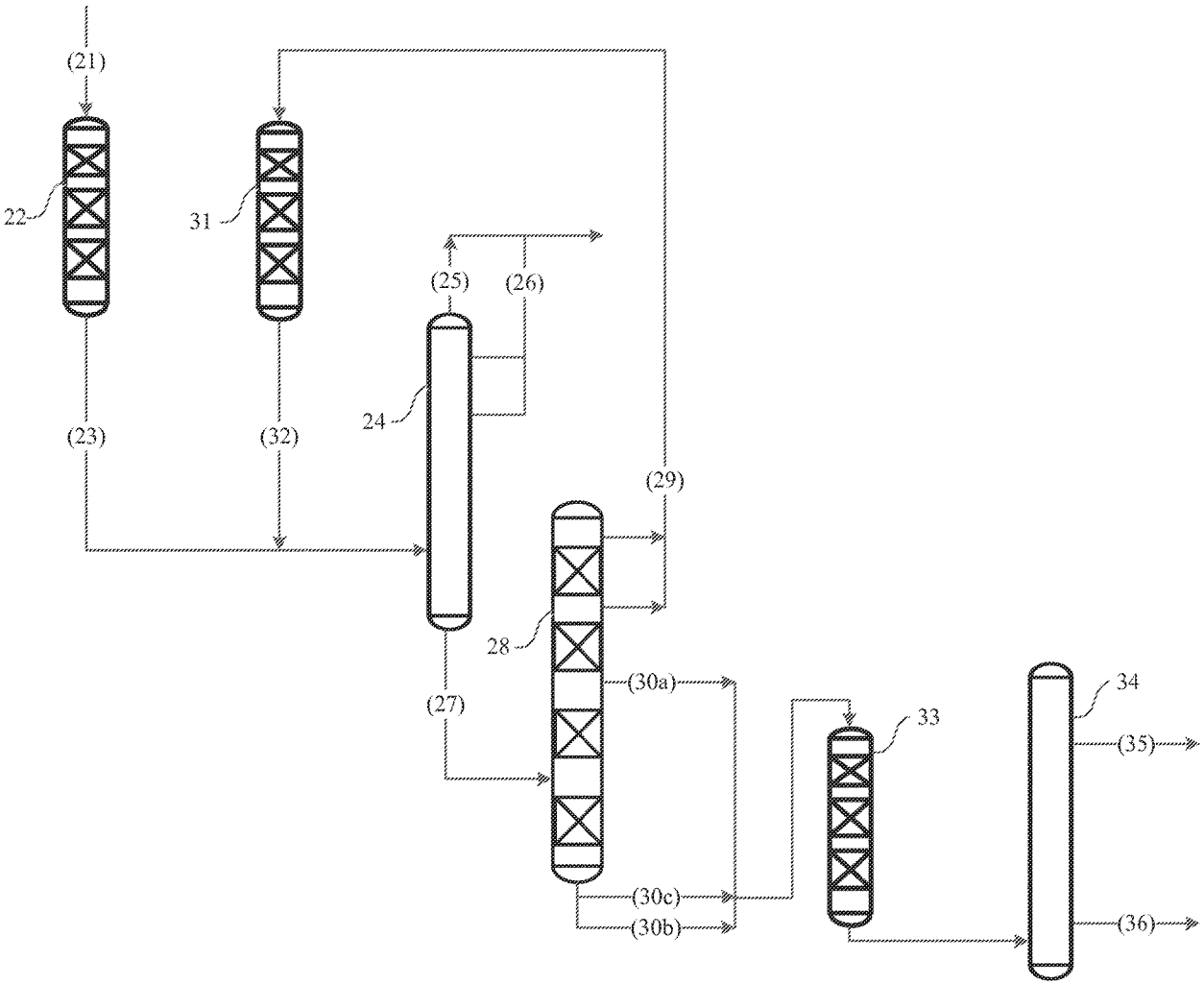
FIG. 2 is a block flow diagram of a refining process for making lubricating base oils from a blended feedstock containing heavy coker gas oil, as described herein

FIG. 2 is a flow scheme for an improved refining process for making heavy lubricating base oils (LBO) from a blended feedstock containing a heavy coker gas oil (HCGO) and/or one or more other feedstocks normally not conducive to lubricating base oil production. The HCGO will be blended with other feedstocks typically used for making heavy LBOs using a hydrocracking operation, such as vacuum gas oil (VGO) feedstocks, deasphalted oil (DAO) feedstocks, and heavy atmospheric gas oil (HAGO) feedstocks.

Though the process described herein is described as using a HCGO feedstock, other highly disadvantaged feedstock having properties similar to a HCGO feedstock and are normally not conducive to heavy LBO basestock production can be used instead of, or with, the HCGO, such as visbroken gas oils, gas oils derived from residue hydrocracking or residue desulfurization, and other thermally or catalytically cracked, aromatic extracts, and cycle oils from an FCC unit.

The flow scheme illustrated in FIG. 2 is particularly suited for hydroprocessing disadvantaged blended feedstocks that ordinarily could not be refined using a conventional two-stage hydrocracking process. These blended feedstocks have high amounts of nitrogen often greater than 3000 ppm and sulfur, often greater than 3 wt %, and a low API Gravity, typically below 17.

The refining equipment used in the refining process described below will consist of conventional process equipment typically used in commercial hydrocracking, hydrodewaxing and hydrofinishing units for recovery of product and unconverted feedstock, including caustic scrubbers, flash drums, suction traps, acid washes, fractionators and separators, and the like.

Each hydrocracking, hydrodewaxing and hydrofinishing stage can be accomplished using one or more fixed bed reactors or reaction zones within a single reactor each of which can include one or more catalyst beds of the same, or different, hydroprocessing catalyst. Although other types of catalyst beds can be used, fixed beds are preferred. Such other types of catalyst beds suitable for use herein include fluidized beds, ebullating beds, slurry beds, and moving beds.

Interstage cooling or heating between reactors or reaction zones, or between catalyst beds in the same reactor or reaction zone, can be employed since the hydrotreating reaction is generally exothermic. A portion of the heat generated during hydrotreating can be recovered. Where this heat recovery option is not available, conventional cooling may be performed through cooling utilities such as cooling water or air, or through use of a hydrogen quench stream. In this manner, optimum reaction temperatures can be more easily maintained.

In the refining scheme illustrated in FIG. 2, a blended HCGO-containing feedstock 21 is subjected to hydrocracking conditions in a first stage hydrocracker unit 22, followed by distillation of the hydrocracked HCGO-containing feedstock 23 in a distillation column 24. The conditions in the first stage hydrocracker unit 22 are selected to produce heavy lubricating base oil having a target viscosity index value, typically greater than 100, and more typically between 100 and 120.

TABLE 1

| 1st Stage Hydrocracking Conditions | |
|---|---|
| Liquid hour space velocity (LHSV) | 0.25-4.0 $hr^{-1}$ |
| $H_2$ partial pressure | 500-2500 psig |
| $H_2$ consumption rate | 1000-3000 SCF/Bbl |
| Operating temperature | 700-850° F. (371-454° C.) |
| Conversion | 30-60% (typically 50%) |

Light ends 25 and middle distillate products fractions 26, such as kerosene and diesel, are recovered from the distillation column 24, and a distillation column bottoms fraction 27 having a 370+° C. boiling point range is subjected to further fractionation in a waxy vacuum distillation column 28 to yield one or more light vacuum gas oil fractions 29 with a 370-500° C. boiling range, and one or more heavy LBO feedstock fractions 30*a* (e.g. 500-570° C. heavy LBO feedstock), 30*b* (e.g. 570+° C. heavy LBO feedstocks). The LBO feedstock fraction physical properties are primarily dictated by the operating conditions selected for the first stage hydrocracker unit 22.

The light vacuum gas oil fractions 29 are subjected to hydrocracking conditions in a second stage hydrocracker unit 31, followed by distillation of the hydrocracked light vacuum gas oil fractions 32 in the distillation column 24.

The light vacuum gas oil fractions 29 having a collective 370-500° C. boiling range. It has been found the selection of the deep cut diesel fraction boil range advantageously affords the removal (by hydrocracking and recycle to extinction) of feedstock components which, if otherwise were not removed, would have a deleterious effect on the properties of the finished heavy LBO products made from the heavy LBO feedstock fractions. These deleterious feedstock components are contained in HCGO feedstocks, and normally boil in the 370-500° C. range. However, by operating the waxy vacuum distillation column 28 to yield one or more light vacuum gas oil fractions 29 with a 370-500° C. boiling range, these deleterious feedstock components can be hydrocracked to extinction.

In one embodiment, where the process of the present invention is operated in a "block-type" operation, the first stage hydrocracker unit conditions are selected to produce target LBO feedstock fractions 30*a*,30*b* from the waxy vacuum distillation column 28 for further conversion to a finished heavy LBO product (e.g. a 22-32 cSt waxy Group II brightstock or 12-13 cSt 600N target product). This embodiment will require tankage for storage of LBO feedstock fractions not passed on for further hydroprocessing.

In an alternate embodiment, the process of the present invention is operated in a "bulk-type" fashion, the first stage hydrocracker unit conditions are selected to produce a target single heavy LBO feedstock fraction 30*c* (e.g. 500+° C. heavy LBO feedstock) for further conversion to a finished heavy LBO product (e.g. a 15-17 cSt 750N target product).

Referring again to FIG. 2, LBO feedstock fractions 30*a*, 30*b*, 30*c* (either individually (30*a*,30*b*) in block operations, or collectively (30*c*) in a bulk operations) are passed to a lubricating oil dewaxing unit 13 where the LBO feedstock fractions 30*a*, 30*b*, 30*c* are subjected to catalytic dewaxing and hydrofinishing in a dewaxing 33, followed by distillation in a vacuum distillation column 34, to yield the finished heavy LBO products 35,36.

The refinery configuration illustrated in FIG. 2 has several advantages over conventional two-stage hydrocracking schemes, single stage with recycle schemes or single stage once through at high conversion. Whereas any of the other conventional hydrocracking schemes would require either a block operation for LBO production, where HCGO is eliminated from the hydrocracker feed, or further severe hydroprocessing of the hydrocrackate from the first stage hydrocracker leading to substantial loss of potential lube products. The process of the present invention allows a refiner to process a HCGO stream in a first stage hydrocracker at relatively milder conditions—lower conversion, higher LHSV, lower catalyst temperature. This is in contrast to a conventional two-stage hydrocracking scheme where the first stage hydrocracking unit would need to be operated at a higher severity necessary to maximize distillate yield which, in turn, requires the unit to be operated at more severe conditions (which requires more hydrogen and reduces the life of the catalyst).

Hydrocracking Catalysts

Catalysts used in carrying out the hydrocracking process includes at least one hydrocracking catalyst support, one or more metals, optionally one or more molecular sieves, and optionally one or more promoters.

For each embodiment described herein, the hydrocracking catalyst support is selected from the group consisting of alumina, silica, zirconia, titanium oxide, magnesium oxide, thorium oxide, beryllium oxide, alumina-silica, alumina-titanium oxide, alumina-magnesium oxide, silica-magnesium oxide, silica-zirconia, silica-thorium oxide, silica-beryllium oxide, silica-titanium oxide, titanium oxide-zirconia, silica-alumina-zirconia, silica-alumina-thorium oxide, silica-alumina-titanium oxide or silica-alumina-magnesium oxide, preferably alumina, silica-alumina, and combinations thereof.

In another subembodiment, the hydrocracking catalyst support is an amorphous silica-alumina material in which the mean mesopore diameter is between 70 Å and 130 Å.

In another subembodiment, the hydrocracking catalyst support is an amorphous silica-alumina material containing $SiO_2$ in an amount of 10 to 70 wt. % of the bulk dry weight of the carrier as determined by ICP elemental analysis, a BET surface area of between 450 and 550 $m^2/g$ and a total pore volume of between 0.75 and 1.05 mL/g.

In another subembodiment, the hydrocracking catalyst support is an amorphous silica-alumina material containing $SiO_2$ in an amount of 10 to 70 wt. % of the bulk dry weight of the carrier as determined by ICP elemental analysis, a BET surface area of between 450 and 550 $m^2/g$, a total pore volume of between 0.75 and 1.05 mL/g, and a mean mesopore diameter is between 70 Å and 130 Å.

For each embodiment described herein, the amount of hydrocracking catalyst support in the hydroprocessing catalyst is from 5 wt. % to 80 wt. % based on the bulk dry weight of the hydroprocessing catalyst.

For each embodiment described herein, the hydroprocessing catalyst may optionally contain one or more molecular sieves selected from the group consisting of BEA-, ISV-, BEC-, IWR-, MTW-, *STO-, OFF-, MAZ-, MOR-, MOZ-, AFI-, *NRE, SSY-, FAU-, EMT-, ITQ-21-, ERT-, ITQ-33-, and ITQ-37-type molecular sieves, and mixtures thereof.

In one subembodiment, the one or more molecular sieves selected from the group consisting of molecular sieves having a FAU framework topology, molecular sieves having a BEA framework topology, and mixtures thereof.

The amount of molecular sieve material in the hydroprocessing catalyst is from 0 wt. % to 60 wt. % based on the bulk dry weight of the hydroprocessing catalyst. In one subembodiment, the amount of molecular sieve material in the hydroprocessing catalyst is from 0.5 wt. % to 40% wt. %.

The catalyst may optionally contain a non-zeolitic molecular sieves which can be used include, for example, silicoaluminophosphates (SAPO), ferroaluminophosphate, titanium aluminophosphate and the various ELAPO molecular sieves described in U.S. Pat. No. 4,913,799 and the references cited therein. Details regarding the preparation of various non-zeolite molecular sieves can be found in U.S. Pat. No. 5,114,563 (SAPO); U.S. Pat. No. 4,913,799 and the various references cited in U.S. Pat. No. 4,913,799. Mesoporous molecular sieves can also be used, for example the M41S family of materials (J. Am. Chem. Soc., 114:10834 10843(1992)), MCM-41 (U.S. Pat. Nos. 5,246,689; 5,198,203; 5,334,368), and MCM-48 (Kresge et al., Nature 359: 710 (1992)).

In one subembodiment, the molecular sieve is a Y zeolite with a unit cell size of 24.15 Å-24.45 Å. In another subembodiment, the molecular sieve is a Y zeolite with a unit cell size of 24.15 Å-24.35 Å. In another subembodiment, the molecular sieve is a low-acidity, highly dealuminated ultrastable Y zeolite having an Alpha value of less than 5 and a Brønsted acidity of from 1 to 40. In one subembodiment, the molecular sieve is a Y zeolite having the properties described in Table 3 below.

TABLE 2

| | |
|---|---|
| Alpha value | 0.01-5 |
| CI | 0.05-5% |
| Brønsted acidity | 1-40 μmole/g |
| SAR | 80-150 |
| surface area | 650-750 $m^2/g$ |
| micropore volume | 0.25-0.30 mL/g |
| total pore volume | 0.51-0.55 mL/g |
| unit cell size | 24.15-24.35 Å |

In another subembodiment, the molecular sieve is a Y zeolite having the properties described in Table 4 below.

TABLE 3

| | |
|---|---|
| SAR | 10-∞ |
| micropore volume | 0.15-0.27 mL/g |
| BET surface area | 700-825 $m^2/g$ |
| unit cell size | 24.15-24.45 Å |

In another subembodiment, the catalyst contains from 0.1 wt. % to 40 wt. % (based on the bulk dry weight of the catalyst) of a Y zeolite having the properties described Table 4 above, and from 1 wt. % to 60 wt. % (based on the bulk dry weight of the catalyst) of a low-acidity, highly dealuminated ultrastable Y zeolite having an Alpha value of less than about 5 and Brønsted acidity of from 1 to 40 micromole/g.

As described herein above, the hydroprocessing catalyst of the present invention contains one or more metals. For each embodiment described herein, each metal employed is selected from the group consisting of elements from Group 6 and Groups 8 through 10 of the Periodic Table, and mixtures thereof. In one subembodiment, each metal is selected from the group consisting of nickel (Ni), cobalt (Co), iron (Fe), chromium (Cr), molybdenum (Mo), tungsten (W), and mixtures thereof. In another subembodiment, the hydroprocessing catalyst contains at least one Group 6 metal and at least one metal selected from Groups 8 through 10 of the Periodic Table. Exemplary metal combinations include Ni/Mo/W, Ni/Mo, Ni/W, Co/Mo, Co/W, Co/W/Mo and Ni/Co/W/Mo.

The total amount of metal oxide material in the hydroprocessing catalyst is from 0.1 wt. % to 90 wt. % based on the bulk dry weight of the hydroprocessing catalyst. In one subembodiment, the hydroprocessing catalyst contains from 2 wt. % to 10 wt. % of nickel oxide and from 8 wt. % to 40 wt. % of tungsten oxide based on the bulk dry weight of the hydroprocessing catalyst.

A diluent may be employed in the formation of the hydroprocessing catalyst. Suitable diluents include inorganic oxides such as aluminum oxide and silicon oxide, titanium oxide, clays, ceria, and zirconia, and mixture of thereof. The amount of diluent in the hydroprocessing catalyst is from 0 wt. % to 35 wt. % based on the bulk dry weight of the hydroprocessing catalyst. In one subembodiment, the amount of diluent in the hydroprocessing catalyst is from 0.1 wt. % to 25 wt. % based on the bulk dry weight of the hydroprocessing catalyst.

The hydroprocessing catalyst of the present invention may contain one or more promoters selected from the group consisting of phosphorous (P), boron (B), fluorine (F), silicon (Si), aluminum (Al), zinc (Zn), manganese (Mn), and mixtures thereof. The amount of promoter in the hydroprocessing catalyst is from 0 wt. % to 10 wt. % based on the bulk dry weight of the hydroprocessing catalyst. In one subembodiment, the amount of promoter in the hydroprocessing catalyst is from 0.1 wt. % to 5 wt. % based on the bulk dry weight of the hydroprocessing catalyst The conditions for the first hydrocracking stage are as follows: the overall liquid hourly space velocity (LHSV) is about 0.25 to 4.0 $hr^{-1}$, preferably about 1.0 to 3.0 $hr^{-1}$. The hydrogen partial pressure is greater than 200 psig, preferably ranging from about 500 to about 2000 psig. Hydrogen re-circulation rates are typically greater than 500 SCF/Bbl, and are preferably between 1000 and 5000 SCF/Bbl. Temperatures range from about 600 to about 850° F., preferably ranging from 700 to 850° F.

Dewaxing Catalysts

Catalysts used in carrying out the hydrocracking process includes at least one dewaxing catalyst support, one or more noble metals, one or more molecular sieves, and optionally one or more promoters.

For each embodiment described herein, the dewaxing catalyst support is selected from the group consisting of alumina, silica, zirconia, titanium oxide, magnesium oxide, thorium oxide, beryllium oxide, alumina-silica, alumina-titanium oxide, alumina-magnesium oxide, silica-magnesium oxide, silica-zirconia, silica-thorium oxide, silica-beryllium oxide, silica-titanium oxide, titanium oxide-zirconia, silica-alumina-zirconia, silica-alumina-thorium oxide, silica-alumina-titanium oxide or silica-alumina-magnesium oxide, preferably alumina, silica-alumina, and combinations thereof.

In another subembodiment, the dewaxing catalyst support is an amorphous silica-alumina material in which the mean mesopore diameter is between 70 Å and 130 Å.

In another subembodiment, the dewaxing catalyst support is an amorphous silica-alumina material containing $SiO_2$ in an amount of 10 to 70 wt. % of the bulk dry weight of the carrier as determined by ICP elemental analysis, a BET surface area of between 450 and 550 $m^2/g$ and a total pore volume of between 0.75 and 1.05 mL/g.

In another subembodiment, the dewaxing catalyst support is an amorphous silica-alumina material containing $SiO_2$ in an amount of 10 to 70 wt. % of the bulk dry weight of the carrier as determined by ICP elemental analysis, a BET surface area of between 450 and 550 $m^2/g$, a total pore volume of between 0.75 and 1.05 mL/g, and a mean mesopore diameter is between 70 Å and 130 Å.

For each embodiment described herein, the amount of dewaxing catalyst support in the hydroprocessing catalyst is from 5 wt. % to 80 wt. % based on the bulk dry weight of the hydroprocessing catalyst.

For each embodiment described herein, the hydroprocessing catalyst may optionally contain one or more molecular sieves selected from the group consisting of SSZ-32, small crystal SSZ-32, ZSM-23, ZSM-48, MCM-22, ZSM-5, ZSM-12, ZSM-22, ZSM-35 and MCM-68. -type molecular sieves, and mixtures thereof.

The amount of molecular sieve material in the hydroprocessing catalyst is from 0 wt. % to 60 wt. % based on the bulk dry weight of the hydroprocessing catalyst. In one subembodiment, the amount of molecular sieve material in the hydroprocessing catalyst is from 0.5 wt. % to 40% wt. %.

As described herein above, the hydroprocessing catalyst of the present invention contains one or more noble metals selected from the group consisting of elements from Group 10 of the Periodic Table, and mixtures thereof. In one subembodiment, each metal is selected from the group consisting of platinum (Pt), paladium (Pd), and mixtures thereof.

Hydrofinishing Catalyst

Catalysts used in carrying out the hydrofinishing process includes at least one hydrofinishing catalyst support, one or more metals, and optionally one or more promoters.

For each embodiment described herein, the hydrofinishing catalyst support is selected from the group consisting of alumina, silica, zirconia, titanium oxide, magnesium oxide, thorium oxide, beryllium oxide, alumina-silica, alumina-titanium oxide, alumina-magnesium oxide, silica-magnesium oxide, silica-zirconia, silica-thorium oxide, silica-beryllium oxide, silica-titanium oxide, titanium oxide-zirconia, silica-alumina-zirconia, silica-alumina-thorium oxide, silica-alumina-titanium oxide or silica-alumina-magnesium oxide, preferably alumina, silica-alumina, and combinations thereof.

In another subembodiment, the hydrofinishing catalyst support is an amorphous silica-alumina material in which the mean mesopore diameter is between 70 Å and 130 Å.

In another subembodiment, the hydrofinishing catalyst support is an amorphous silica-alumina material containing $SiO_2$ in an amount of 10 to 70 wt. % of the bulk dry weight of the carrier as determined by ICP elemental analysis, a BET surface area of between 450 and 550 $m^2/g$ and a total pore volume of between 0.75 and 1.05 mL/g.

In another subembodiment, the hydrofinishing catalyst support is an amorphous silica-alumina material containing $SiO_2$ in an amount of 10 to 70 wt. % of the bulk dry weight of the carrier as determined by ICP elemental analysis, a BET surface area of between 450 and 550 $m^2/g$, a total pore volume of between 0.75 and 1.05 mL/g, and a mean mesopore diameter is between 70 Å and 130 Å.

For each embodiment described herein, the amount of hydrofinishing catalyst support in the hydroprocessing catalyst is from 5 wt. % to 80 wt. % based on the bulk dry weight of the hydroprocessing catalyst.

As described herein above, the hydrofinishing catalyst may contain one or more metals selected from the group consisting of elements from Group 6 and Groups 8 through 10 of the Periodic Table, and mixtures thereof. In one subembodiment, each metal is selected from the group consisting of nickel (Ni), cobalt (Co), iron (Fe), chromium (Cr), molybdenum (Mo), tungsten (W), and mixtures thereof. In another subembodiment, the hydroprocessing catalyst contains at least one Group 6 metal and at least one metal selected from Groups 8 through 10 of the Periodic Table. Exemplary metal combinations include Ni/Mo/W, Ni/Mo, Ni/W, Co/Mo, Co/W, Co/W/Mo and Ni/Co/W/Mo.

The total amount of metal oxide material in the hydrofinishing catalyst is from 0.1 wt. % to 90 wt. % based on the bulk dry weight of the hydroprocessing catalyst. In one subembodiment, the hydroprocessing catalyst contains from 2 wt. % to 10 wt. % of nickel oxide and from 8 wt. % to 40 wt. % of tungsten oxide based on the bulk dry weight of the hydroprocessing catalyst.

A diluent may be employed in the formation of the hydrofinishing catalyst. Suitable diluents include inorganic oxides such as aluminum oxide and silicon oxide, titanium oxide, clays, ceria, and zirconia, and mixture of thereof. The amount of diluent in the hydroprocessing catalyst is from 0 wt. % to 35 wt. % based on the bulk dry weight of the hydroprocessing catalyst. In one subembodiment, the amount of diluent in the hydroprocessing catalyst is from 0.1 wt. % to 25 wt. % based on the bulk dry weight of the hydroprocessing catalyst.

The hydrofinishing catalyst of the present invention may contain one or more promoters selected from the group consisting of phosphorous (P), boron (B), fluorine (F), silicon (Si), aluminum (Al), zinc (Zn), manganese (Mn), and mixtures thereof. The amount of promoter in the hydroprocessing catalyst is from 0 wt. % to 10 wt. % based on the bulk dry weight of the hydroprocessing catalyst. In one subembodiment, the amount of promoter in the hydroprocessing catalyst is from 0.1 wt. % to 5 wt. % based on the bulk dry weight of the hydroprocessing catalyst.

In one embodiment, the hydrofinishing catalyst is a bulk metal or multi-metallic catalyst wherein the amount of metal is 30 wt. % or greater, based on the bulk dry weight of the hydrotreating catalyst.

What is claimed is:

1. A process for producing a heavy lubricating base oil, comprising:

hydrocracking a heavy coker gas oil-containing feedstock in a first-stage hydrocracker to produce a hydrocracked heavy coker gas oil-containing feedstock;

distilling the hydrocracked heavy coker gas oil-containing feedstock to form at least one middle distillate fraction and a distillation bottoms fraction;

further distilling the distillation bottoms fraction to form at least one light vacuum gas oil fraction and at least one heavy lubricating base oil feedstock fraction; and hydrocracking the fraction consisting of the at least one light vacuum gas oil fraction in a second-stage hydrocracker to form a hydrocracked light vacuum gas oil fraction;

wherein the process produces a heavy lubricating base oil product.

2. The process of claim 1, further comprising the step of combining the hydrocracked light vacuum gas oil fraction with the hydrocracked heavy coker gas oil-containing feedstock.

3. The process of claim 1, further comprising the step of dewaxing the at least one heavy lubricating base oil feedstock fraction to form at least one dewaxed heavy lubricating base oil feedstock fraction.

4. The process of claim 3, further comprising the step of distilling the at least one dewaxed heavy lubricating base oil feedstock fraction into at least one finished heavy lubricating base oil product.

5. The process of claim 3, wherein the first-stage hydrocracker is operated to produce lubricating base oil fractions from the further distillation of the distillation bottoms fraction.

6. The process of claim 1, wherein the step of further distilling the distillation bottoms fraction comprises forming at least one light vacuum gas oil fraction and a single heavy lubricating base oil fraction.

7. The process of claim 6, wherein the single heavy lubricating base oil fraction has a boiling range of greater than 500° C.

8. The process of claim 6, further comprising the step of dewaxing the single heavy lubricating base oil feedstock fraction to form a dewaxed heavy lubricating base oil feedstock fraction.

9. The process of claim 6, further comprising the step of distilling the dewaxed heavy lubricating base oil feedstock fraction into a finished heavy lubricating base oil product.

10. The process of claim 9, wherein the finished heavy lubricating base oil product is a 15 to 17 cSt 750N product.

11. The process of claim 1, wherein the step of further distilling the distillation bottoms fraction to form at least one light vacuum gas oil fraction and at least one heavy lubricating base oil feedstock fraction, is performed using a distillation column.

12. The process of claim 1, wherein the at least one light vacuum gas oil fraction has a boiling range of 370 to 500° C.

13. The process of claim 1, wherein the step of further distilling the distillation bottoms fraction comprises forming at least one light vacuum gas oil fraction, a 500 to 570° C. heavy lubricating base oil fraction, and a greater than 570° C. heavy lubricating base oil fraction.

14. The process of claim 1, wherein the heavy coker gas oil-containing feedstock contains greater than 3,000 ppm nitrogen, greater than 3 wt. % sulfur, and an API gravity of less than 17.

15. The process of claim 2, further comprising dewaxing the at least one heavy lubricating base oil feedstock fraction to form at least one dewaxed heavy lubricating base oil feedstock fraction.

16. The process of claim 15, further comprising distilling the at least one dewaxed heavy lubricating base oil feedstock fraction into at least one finished heavy lubricating base oil product.

17. The process of claim 15, wherein the first-stage hydrocracker is operated to produce lubricating base oil fractions from the further distillation of the distillation bottoms fraction.

18. The process of claim 1, wherein the heavy lubricating base oil produced is a 600N product, a 750N product, or a 22-32 cSt Group II brightstock product.

* * * * *